US011591772B2

(12) United States Patent
Minagawa et al.

(10) Patent No.: US 11,591,772 B2
(45) Date of Patent: Feb. 28, 2023

(54) WORK MACHINE CONTROL DEVICE AND CONTROL METHOD

(71) Applicant: Komatsu Ltd., Tokyo (JP)

(72) Inventors: Masanori Minagawa, Tokyo (JP); Yasuhiro Ohyama, Tokyo (JP)

(73) Assignee: Komatsu Ltd., Tokyo (JP)

( * ) Notice: Subject to any disclaimer, the term of this patent is extended or adjusted under 35 U.S.C. 154(b) by 490 days.

(21) Appl. No.: 16/628,738

(22) PCT Filed: Oct. 3, 2018

(86) PCT No.: PCT/JP2018/037019
§ 371 (c)(1),
(2) Date: Jan. 6, 2020

(87) PCT Pub. No.: WO2019/069975
PCT Pub. Date: Apr. 11, 2019

(65) Prior Publication Data

US 2020/0283993 A1 Sep. 10, 2020

(30) Foreign Application Priority Data

Oct. 4, 2017 (JP) ..... JP2017-194672

(51) Int. Cl.
*E02F 9/20* (2006.01)
*E02F 3/43* (2006.01)
*E02F 3/30* (2006.01)

(52) U.S. Cl.
CPC ..... *E02F 9/2041* (2013.01); *E02F 3/439* (2013.01); *E02F 9/205* (2013.01); *E02F 3/308* (2013.01)

(58) Field of Classification Search
CPC ..... E02F 9/2041; E02F 9/205; E02F 9/2033; E02F 3/439; E02F 3/308; E02F 3/435
See application file for complete search history.

(56) References Cited

U.S. PATENT DOCUMENTS 6,223,110 B1 4/2001 Rowe et al.
6,363,632 B1 4/2002 Stentz et al.
(Continued)

FOREIGN PATENT DOCUMENTS

CN 106662878 A 5/2017
CN 107002387 A 8/2017
(Continued)

OTHER PUBLICATIONS

Translation of JP09244745A, 1997.*

*Primary Examiner* — Russell Frejd
(74) *Attorney, Agent, or Firm* — Locke Lord LLP

(57) ABSTRACT

A work machine control device for controlling a work machine includes a transport vehicle information acquisition unit and a dumping position specifying unit, the work machine including a swing body and work equipment attached to the swing body and including a bucket. The transport vehicle information acquisition unit acquires position information and azimuth direction information of an unmanned transport vehicle, the position information and the azimuth direction information being detected by the unmanned transport vehicle. The dumping position specifying unit specifies a dumping position for loading earth and sand onto the unmanned transport vehicle based on the position information and the azimuth direction information.

6 Claims, 11 Drawing Sheets

(56) References Cited

U.S. PATENT DOCUMENTS

| | | | | |
|---|---|---|---|---|
| 6,691,010 | B1 | 2/2004 | Gay | |
| 7,901,009 | B2 * | 3/2011 | Hagenbuch | B60P 1/286 298/23 D |
| 2008/0195365 | A1 | 8/2008 | Ohkura et al. | |
| 2013/0211712 | A1 | 8/2013 | Takeda | |
| 2013/0325208 | A1 | 12/2013 | Osagawa et al. | |
| 2014/0046540 | A1 | 2/2014 | Ruth | |
| 2014/0261152 | A1 | 9/2014 | Tanaka et al. | |
| 2015/0178859 | A1 | 6/2015 | Takeda | |
| 2016/0224026 | A1 * | 8/2016 | Hamada | G05D 1/0044 |
| 2017/0269591 | A1 | 9/2017 | Tanaka et al. | |
| 2017/0277163 | A1 | 9/2017 | Koshi et al. | |
| 2017/0315553 | A1 | 11/2017 | Kadono et al. | |
| 2018/0354412 | A1 | 12/2018 | Ogihara et al. | |

FOREIGN PATENT DOCUMENTS

| | | | | |
|---|---|---|---|---|
| EP | 3409849 | A1 | 12/2018 | |
| JP | 09244745 | A * | 9/1997 | E02F 9/205 |
| JP | 11-247231 | A | 9/1999 | |
| JP | 2000-136549 | A | 5/2000 | |
| JP | 2002-115271 | A | 4/2002 | |
| JP | 2002-332655 | A | 11/2002 | |
| JP | 2012-022611 | A | 2/2012 | |
| JP | 2012-113429 | A | 6/2012 | |
| WO | 2005/106139 | A1 | 11/2005 | |
| WO | 2013/058247 | A1 | 4/2013 | |
| WO | 2015/025369 | A1 | 2/2015 | |
| WO | 2015/087382 | A1 | 6/2015 | |
| WO | 2015/087430 | A1 | 6/2015 | |
| WO | 2017/104329 | A1 | 6/2017 | |
| WO | 2017/131194 | A1 | 8/2017 | |

* cited by examiner

WORK MACHINE CONTROL DEVICE AND CONTROL METHOD

TECHNICAL FIELD

The present invention relates to a work machine control device and a control method for controlling a work machine at a work site at which a work machine and an unmanned transport vehicle are provided.

Priority is claimed on Japanese Patent Application No. 2017-194672, filed on Oct. 4, 2017, the content of which is incorporated herein by reference.

BACKGROUND ART

PTL 1 and PTL 2 disclose techniques of automatically operating a hydraulic shovel by designating an excavation position and a dumping position.

CITATION LIST

Patent Literature

[PTL 1] Japanese Unexamined Patent Application, First Publication No. 2002-115271

[PTL 2] Japanese Unexamined Patent Application, First Publication No. 2002-332655

DISCLOSURE OF INVENTION

Technical Problem

In order to improve efficiency of automatic control, it is desirable to skip designation of a dumping position.

An aspect of the present invention is to provide a work machine control device and a control method capable of automatically specifying a dumping position for control of a work machine.

Solution to Problem

According to a first aspect of the present invention, a work machine control device for controlling a work machine that includes a swing body which swings around the center of swing and work equipment attached to the swing body and including a bucket, the work machine control device includes: a transport vehicle information acquisition unit that acquires position information and azimuth direction information of an unmanned transport vehicle that is present at a loading place within a reaching range of the bucket, from a transport vehicle control device for controlling travel of the unmanned transport vehicle based on position information, azimuth direction information, and a predetermined traveling route of the unmanned transport vehicle; and a dumping position specifying unit that specifies a dumping position for loading a load onto the unmanned transport vehicle based on the position information and the azimuth direction information.

Advantageous Effects of Invention

According to the aspect, the work machine control device can automatically specify a dumping position for control of a work machine.

BEST MODE FOR CARRYING OUT THE INVENTION

First Embodiment

«Work System»

Figure 1:
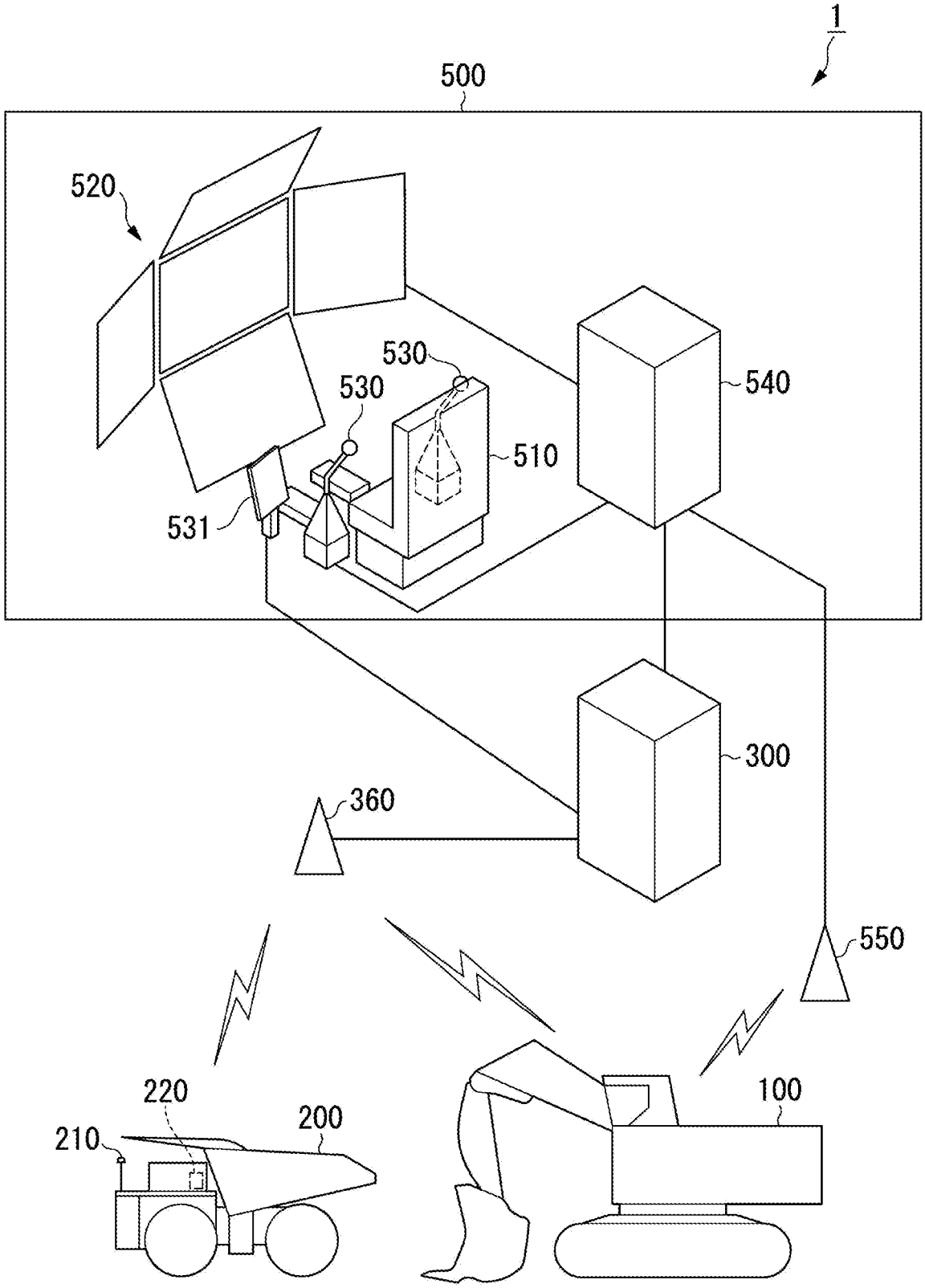
FIG. 1 is a schematic diagram showing a configuration of a remote operation system according to a first embodiment.

FIG. 1 is a schematic diagram showing a configuration of a remote operation system according to a first embodiment.

A work system 1 includes a work machine 100, one or more transport vehicles 200 which are unmanned transport vehicles, a management apparatus 300, and a remote operation room 500. The work machine 100 and the transport vehicle 200 operate at a work site (for example, a mine, a quarry, or the like). The remote operation room 500 is provided at a place away from the work site (for example, a city, a place in the work site, or the like).

The transport vehicle 200 performs unmanned travel based on control information received from the management apparatus 300. The transport vehicle 200 and the management apparatus 300 are connected to each other by communication via an access point 360. The management apparatus 300 acquires a position and an azimuth direction of the transport vehicle 200 from the transport vehicle 200, and generates course information used for travel of the transport vehicle 200 based on the position and the azimuth direction of the transport vehicle 200. The management apparatus 300 transmits the course information to the transport vehicle 200. The transport vehicle 200 performs unmanned travel based on the received course information. That is, the work system 1 includes an unmanned conveyance system including the transport vehicle 200 and the management apparatus 300. The access point 360 is used for communication of the unmanned conveyance system.

The management apparatus 300 receives an instruction signal of the transport vehicle 200 from the work machine 100 and the remote operation room 500, and transmits the instruction signal to the transport vehicle 200. The work machine 100 and the management apparatus 300 are connected to each other by communication via the access point 360. Further, the remote operation room 500 and the management apparatus 300 are connected to each other via a network. Examples of the instruction signal of the transport vehicle 200 received from the work machine 100 and the remote operation room 500 include an entry instruction signal and a start instruction signal. The entry instruction signal is a signal for instructing the transport vehicle 200 to enter from a standby point P1 to a loading point P3. The start instruction signal is a signal for instructing the transport vehicle 200 to start from the loading point P3 and leave a loading place A1 when loading is completed.

The work machine 100 is remotely operated based on an operation signal transmitted from the remote operation room 500. The work machine 100 and the remote operation room 500 are connected to each other by communication via an access point 550. In the remote operation room 500, a first operation device 530 receives an operation of the work machine 100 by an operation of an operator, and a control device 540 transmits an operation signal to the management apparatus 300. The work machine 100 operates based on the operation signal received from the remote operation room 500. That is, the work system 1 includes a remote operation system including the work machine 100 and the remote operation room 500. The access point 350 is used for communication of the remote operation system.

«Transport Vehicle»

The transport vehicle 200 according to the first embodiment is an unmanned dump truck that performs unmanned travel on a set traveling route. The transport vehicle 200 according to another embodiment may be a transport vehicle other than a dump truck.

The transport vehicle 200 includes a position and azimuth direction detector 210 and a control device 220.

The position and azimuth direction detector 210 detects a position and an azimuth direction of the transport vehicle 200. The position and azimuth direction detector 210 includes two receivers that receive positioning signals from satellites of a global navigation satellite system (GNSS). As an example of the GNSS, the Global Positioning System (GPS) may be used. The two receivers are each provided at different positions of the transport vehicle 200. The position and azimuth direction detector 210 detects a position of a representative point of the transport vehicle 200 in a work site coordinate system (the origin of a vehicle-body coordinate system, for example, the center position of a rear axle of the transport vehicle 200) based on the positioning signals received by the receivers.

The position and azimuth direction detector 210 calculates the azimuth direction of the transport vehicle 200 as a relationship between a position of one receiver and a position of the other receiver, using each of the positioning signals received by the two receivers. In another embodiment, the configuration is not limited thereto. For example, the transport vehicle 200 may include an inertial measurement unit (IMU), and may calculate the azimuth direction based on a measurement result of the inertial measurement unit. In this case, a drift of the inertial measurement unit may be corrected based on a traveling trajectory of the transport vehicle 200. In the case of calculating the azimuth direction using the inertial measurement unit, the transport vehicle 200 may include one receiver.

The control device 220 transmits the position and the azimuth direction detected by the position and azimuth direction detector 210 to the management apparatus 300. The control device 220 receives the course information and the instruction signal from the management apparatus 300. The control device 220 causes the transport vehicle 200 to travel or causes the vessel of the transport vehicle 200 to be raised or lowered based on the received course information and the received instruction signal.

«Work Machine»

Figure 2:
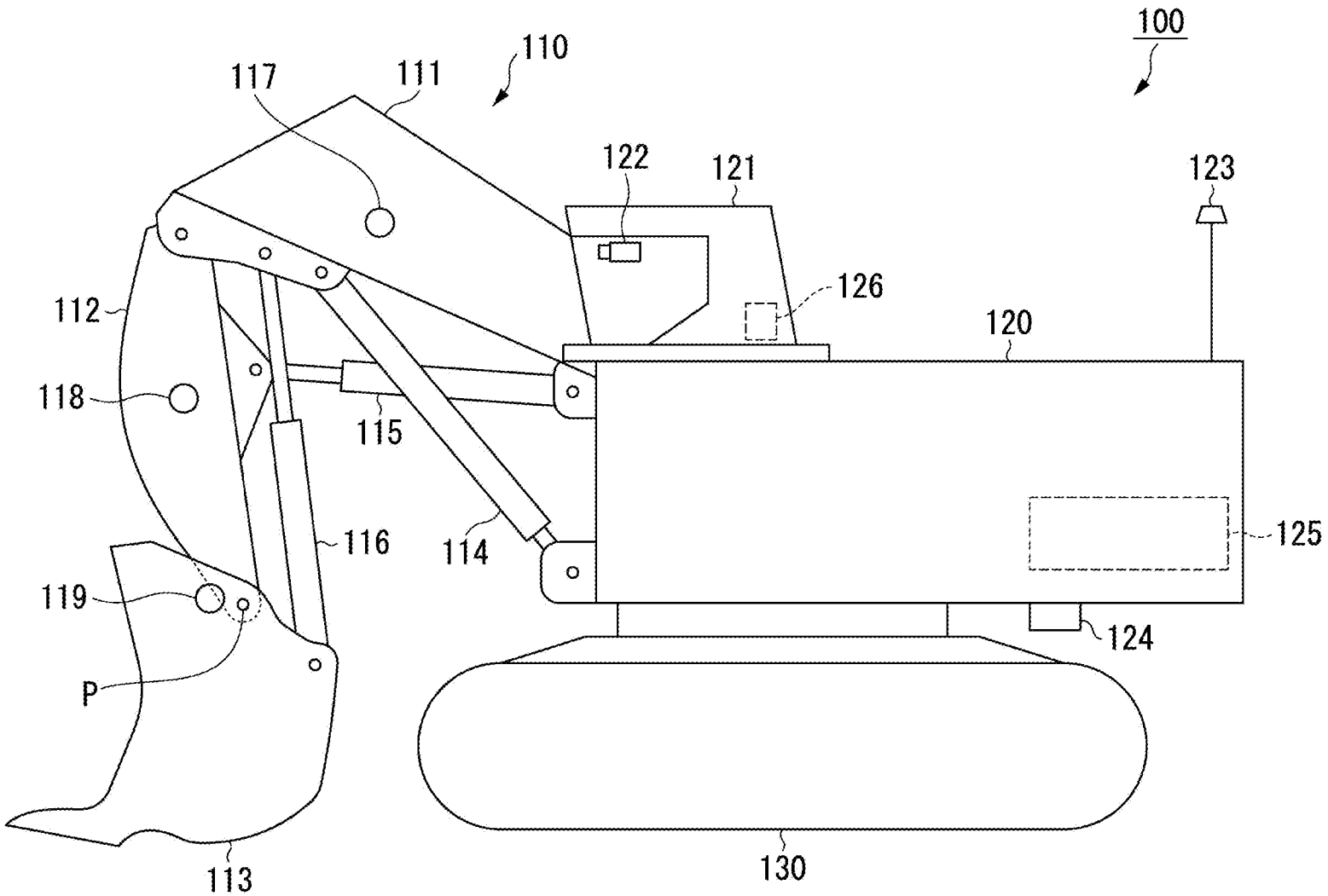
FIG. 2 is an external view of a work machine according to the first embodiment.

FIG. 2 is an external view of the work machine according to the first embodiment.

The work machine 100 according to the first embodiment is a hydraulic shovel that is a type of loading machine. The work machine 100 according to another embodiment may be a work machine other than a hydraulic shovel. Although the work machine 100 shown in FIG. 2 is a face shovel, the work machine 100 may be a backhoe shovel or a rope shovel.

The work machine 100 includes a traveling body 130, a swing body 120 supported by the traveling body 130, and work equipment 110 that is operated by a hydraulic pressure and is supported by the swing body 120. The swing body 120 is supported so as to be swingable around a center of swing.

The work equipment 110 includes a boom 111, an arm 112, a bucket 113, a boom cylinder 114, an arm cylinder 115, a bucket cylinder 116, a boom angle sensor 117, an arm angle sensor 118, and a bucket angle sensor 119.

A base end portion of the boom 111 is attached to the swing body 120 via a pin.

The arm 112 connects the boom 111 and the bucket 113. A base end portion of the arm 112 is attached to a front end portion of the boom 111 via a pin.

The bucket 113 includes a blade for excavating earth and sand and a container for containing the excavated earth and sand. A base end portion of the bucket 113 is attached to a front end portion of the arm 112 via a pin.

The boom cylinder 114 is a hydraulic cylinder for operating the boom 111. A base end portion of the boom cylinder 114 is attached to the swing body 120. A front end portion of the boom cylinder 114 is attached to the boom 111.

The arm cylinder 115 is a hydraulic cylinder for driving the arm 112. Abase end portion of the arm cylinder 115 is attached to the boom 111. A front end portion of the arm cylinder 115 is attached to the arm 112.

The bucket cylinder 116 is a hydraulic cylinder for driving the bucket 113. A base end portion of the bucket cylinder 116 is attached to the boom 111. A front end portion of the bucket cylinder 116 is attached to the bucket 113.

The boom angle sensor 117 is attached to the boom 111, and detects a tilt angle of the boom 111.

The arm angle sensor 118 is attached to the arm 112, and detects a tilt angle of the arm 112.

The bucket angle sensor 119 is attached to the bucket 113, and detects a tilt angle of the bucket 113.

Each of the boom angle sensor 117, the arm angle sensor 118, and the bucket angle sensor 119 according to the first embodiment detects a tilt angle with respect to a ground plane. The angle sensors according to another embodiment are not limited thereto, and may each detect tilt angles with respect to another reference plane. For example, in another embodiment, the angle sensors may each detect relative rotation angles by potentiometers provided at the base end portions of the boom 111, the arm 112 and the bucket 113, or may each detect tilt angles by measuring cylinder lengths of the boom cylinder 114, the arm cylinder 115, and the bucket cylinder 116 and by converting the cylinder lengths into angles.

An operation room 121 is provided on the swing body 120. An imaging device 122 is provided at an upper portion of the operation room 121. The imaging device 122 is provided at a forward and upward portion in the operation room 121. The imaging device 122 captures an image in front of the operation room 121 via a windshield at a front surface of the operation room 121. Examples of the imaging device 122 include, for example, an imaging device using a charge coupled device (CCD) sensor or a complementary metal oxide semiconductor (CMOS) sensor. In another embodiment, the imaging device 122 may not necessarily be provided in the operation room 121, and the imaging device 122 may be provided at a position at which at least a work target and the work equipment 110 may be imaged.

The work machine 100 includes the imaging device 122, a position and azimuth direction calculator 123, a tilt measurement device 124, a hydraulic device 125, and a control device 126.

The position and azimuth direction calculator 123 calculates a position of the swing body 120 and an azimuth direction of a facing direction of the swing body 120. The position and azimuth direction calculator 123 includes two receivers that receive positioning signals from satellites of the GNSS. The two receivers are each provided at a different position of the swing body 120. The position and azimuth direction calculator 123 detects a position of a representative point of the swing body 120 in a work site coordinate system (the origin of a shovel coordinate system) based on the positioning signals received by the receivers.

The position and azimuth direction calculator 123 calculates the azimuth direction of the facing direction of the swing body 120 as a relationship between a position of one receiver and a position of the other receiver, using each of the positioning signals received by the two receivers.

The tilt measurement device 124 measures acceleration and an angular velocity of the swing body 120, and detects a posture (for example, a roll angle, a pitch angle, and a yaw angle) of the swing body 120 based on the measurement result. The tilt measurement device 124 is provided, for example, on a lower surface of the swing body 120. As the tilt measurement device 124, for example, an inertial measurement unit (IMU) may be used.

The hydraulic device 125 includes a hydraulic fluid tank, a hydraulic pump, and a flow control valve. The hydraulic pump is driven by power of an engine (not shown), and supplies a hydraulic fluid to the boom cylinder 114, the arm cylinder 115, and the bucket cylinder 116 via the flow control valve. The flow control valve includes a rod-shaped spool, and adjusts a flow rate of the hydraulic fluid supplied to the boom cylinder 114, the arm cylinder 115, and the bucket cylinder 116 according to a position of the spool. The spool is driven based on a control command received from the control device 126. That is, an amount of the hydraulic fluid supplied to the boom cylinder 114, the arm cylinder 115, and the bucket cylinder 116 is controlled by the control device 126.

The control device 126 transmits the image captured by the imaging device 122, the swing speed, the position, and the azimuth direction of the swing body 120, the tilt angles of the boom 111, the arm 112, and the bucket 113, the traveling speed of the traveling body 130, and the posture of the swing body 120, to the remote operation room 500. Hereinafter, the image, the swing speed, the position, and the azimuth direction of the swing body 120, the tilt angles of the boom 111, the arm 112, and the bucket 113, the traveling speed of the traveling body 130, and the posture of the swing body 120 are also referred to as vehicle information. The vehicle information according to another embodiment is not limited thereto. For example, the vehicle information according to another embodiment may not include any of the swing speed, the position, the azimuth direction, the tilt angle, the traveling speed, and the posture, may include a value detected by another sensor, or may include a value calculated from the detected value.

The control device 126 receives an operation signal from the remote operation room 500. The control device 126 drives the work equipment 110, the swing body 120, or the traveling body 130 based on the received operation signal.

«Management Apparatus»

Figure 3:
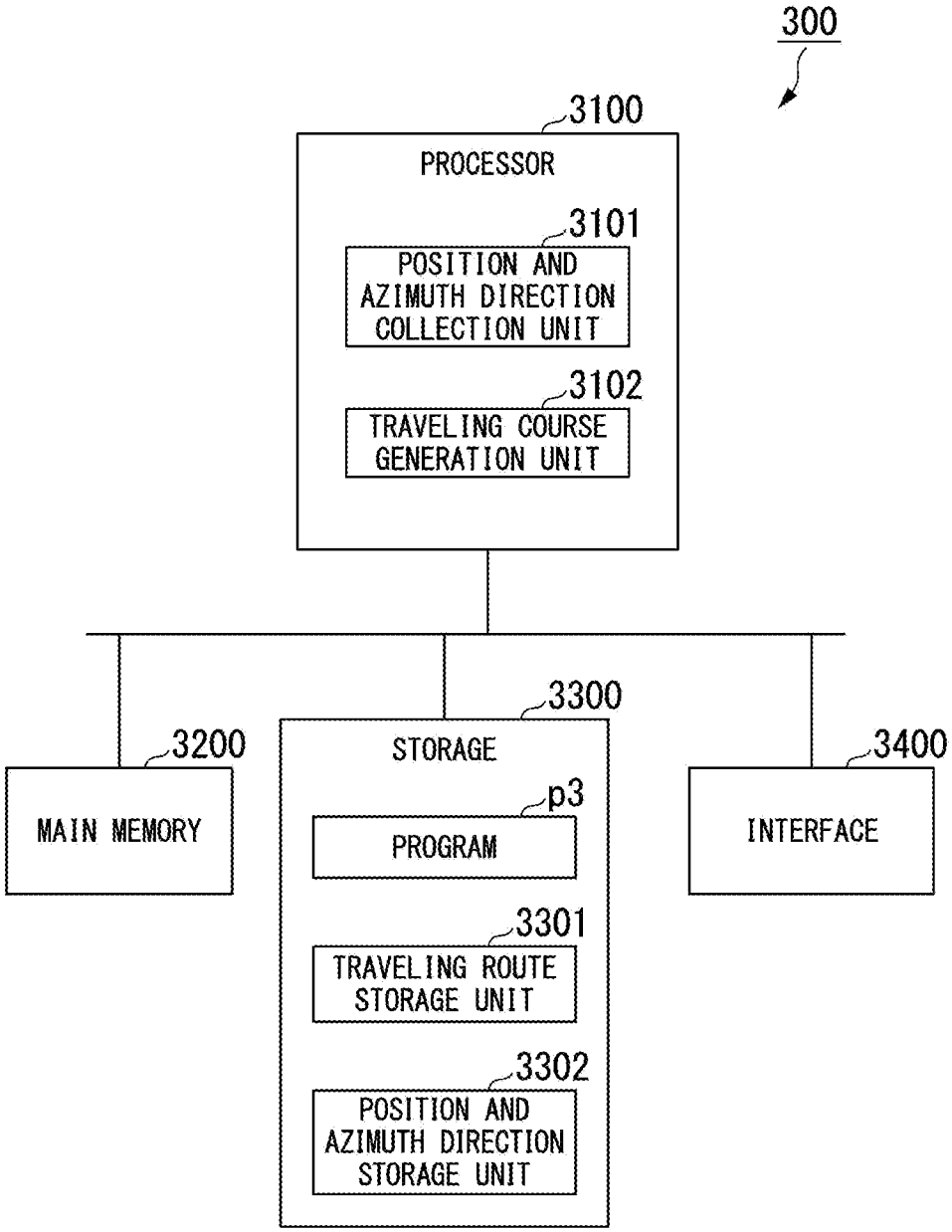
FIG. 3 is a schematic block diagram showing a configuration of a management apparatus according to the first embodiment.

FIG. 3 is a schematic block diagram showing a configuration of the management apparatus according to the first embodiment.

The management apparatus 300 manages travel of the transport vehicle 200.

The management apparatus 300 is a computer including a processor 3100, a main memory 3200, a storage 3300, and an interface 3400. The storage 3300 stores a program p3. The processor 3100 reads the program p3 from the storage 3300, loads the program p3 in the main memory 3200, and executes processing according to the program p3. The management apparatus 300 is connected to the network via the interface 3400. The access point 360 is connected to the interface 3400. The management apparatus 300 is wirelessly connected to the work machine 100 and the transport vehicle 200 via the access point 360.

The storage 3300 includes storage areas as a traveling route storage unit 3301 and a position and azimuth direction storage unit 3302. Examples of the storage 3300 include a hard disk drive (HDD), a solid state drive (SSD), a magnetic disk, an optical magnetic disk, a compact disc read only memory (CD-ROM), a digital versatile disc read only memory (DVD-ROM), a semiconductor memory, and the like. The storage 3300 may be an internal medium directly connected to a common communication line of the management apparatus 300, or may be an external medium connected to the management apparatus 300 via the interface 3400. The storage 3300 is a non-temporary tangible storage medium.

Figure 4:
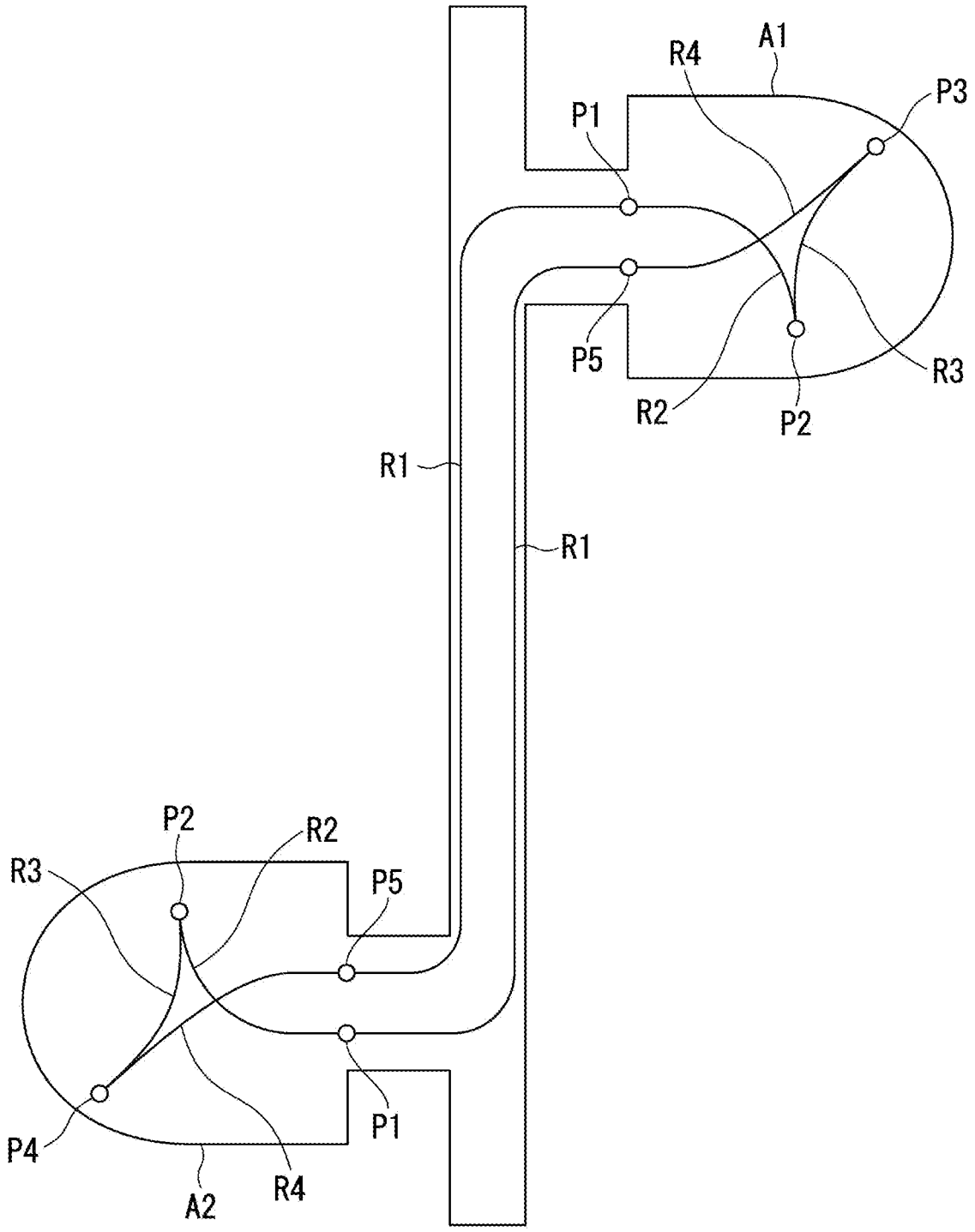
FIG. 4 is a diagram showing an example of a traveling route.

The traveling route storage unit 3301 stores a traveling route R for each transport vehicle 200. FIG. 4 is a diagram showing an example of a traveling route. The traveling route R includes a predetermined connection route R1 connecting two areas A (for example, a loading place A1 and a dumping place A2), an entry route R2, an approach route R3, and an exit route R4 which are routes in the area A. The entry route R2 is a route connecting a standby point P1 as one end of the connection route R1 and a predetermined turning point P2 in the area A. The approach route R3 is a route connecting the turning point P2 and a loading point P3 or a dumping point P4 in the area A. The exit route R4 is a route connecting the loading point P3 or the dumping point P4 and an exit point P5 as the other end of the connection route R1 in the area A. The loading point P3 is a point which is set by an operation of the operator of the work machine 100. The turning point P2 is a point which is set by the management apparatus 300 according to the position of the loading point P3.

The position and azimuth direction storage unit 3302 stores position information and azimuth direction information of each transport vehicle 200.

The processor 3100 includes a position and azimuth direction collection unit 3101 and a traveling course generation unit 3102 by execution of the program p3.

The position and azimuth direction collection unit 3101 receives position information and azimuth direction information of the transport vehicle 200 from the transport vehicle 200 via the access point 360. The position and azimuth direction collection unit 3101 causes the position and azimuth direction storage unit 3302 to store the received position information and the received azimuth direction information.

The traveling course generation unit 3102 generates course information including information of an area in which movement of the transport vehicle 200 is permitted, based on the traveling route stored in the traveling route storage unit 3301 and the position information and the azimuth direction information stored in the position and azimuth direction storage unit 3302. The generated course information is transmitted to the transport vehicle 200. The course information includes position information of points which are set at predetermined intervals on the traveling route, target speed information at the points, and information of a traveling permission area that does not overlap with traveling permission areas of the other transport vehicles 200.

The traveling course generation unit 3102 does not include the entry route R2 and the approach route R3 in an area indicated by the course information until an entry instruction signal is received from the remote operation room 500. Thereby, the transport vehicle 200 stands by at the standby point P1 until an entry instruction signal is received. In a case where an entry instruction signal is received, the traveling course generation unit 3102 generates course information that includes the entry route R2 and the approach route R3 and does not include the exit route R4. Thereby, the transport vehicle 200 starts from the standby point P1, travels to the loading point P3, and stops at the loading point P3. In a case where a start instruction signal is received, the traveling course generation unit 3102 generates course information including the exit route R4. In the work system 1 according to the present embodiment, the transport vehicle 200 stands by at the standby point P1 until an entry instruction signal is received; however, the present invention is not limited thereto. For example, in another embodiment, the position at which the transport vehicle 200 stands by may be the turning point P2, or may be a middle point on the entry route R2 or the approach route R3.

«Remote Operation Room»

The remote operation room 500 includes a driver's seat 510, a display device 520, a first operation device 530, a second operation device 531, and a control device 540.

The display device 520 is disposed in front of the driver's seat 510. The display device 520 is located in front of the operator's eyes when the operator sits on the driver's seat 510. The display device 520 may be configured with a plurality of displays arranged side by side as shown in FIG. 1, or may be configured with one large display. Further, the display device 520 may be a device that projects an image on a curved surface or a spherical surface by a projector or the like.

The first operation device 530 is an operation device for the remote operation system. The first operation device 530 generates an operation signal of the boom cylinder 114, an operation signal of the arm cylinder 115, an operation signal of the bucket cylinder 116, an operation signal for left swing or right swing of the swing body 120, or an operation signal for forward travel or backward travel of the traveling body 130 according to an operation of the operator, and outputs the generated signal to the control device 540. The first operation device 530 is configured with, for example, a lever, a knob switch, and a pedal.

The second operation device 531 transmits an entry instruction signal, a start instruction signal, a stop instruction signal, or a stop release signal for the transport vehicle 200 according to an operation of the operator, to the management apparatus 300. The second operation device 531 is configured with, for example, a touch panel.

The first operation device 530 and the second operation device 531 are disposed in the vicinity of the driver's seat 510. The first operation device 530 and the second operation device 531 are located within an operable range of the operator when the operator sits on the driver's seat 510.

The control device 540 causes the display device 520 to display the image received from the work machine 100, and transmits an operation signal indicating an operation of the first operation device 530 to the work machine 100.

Figure 5:
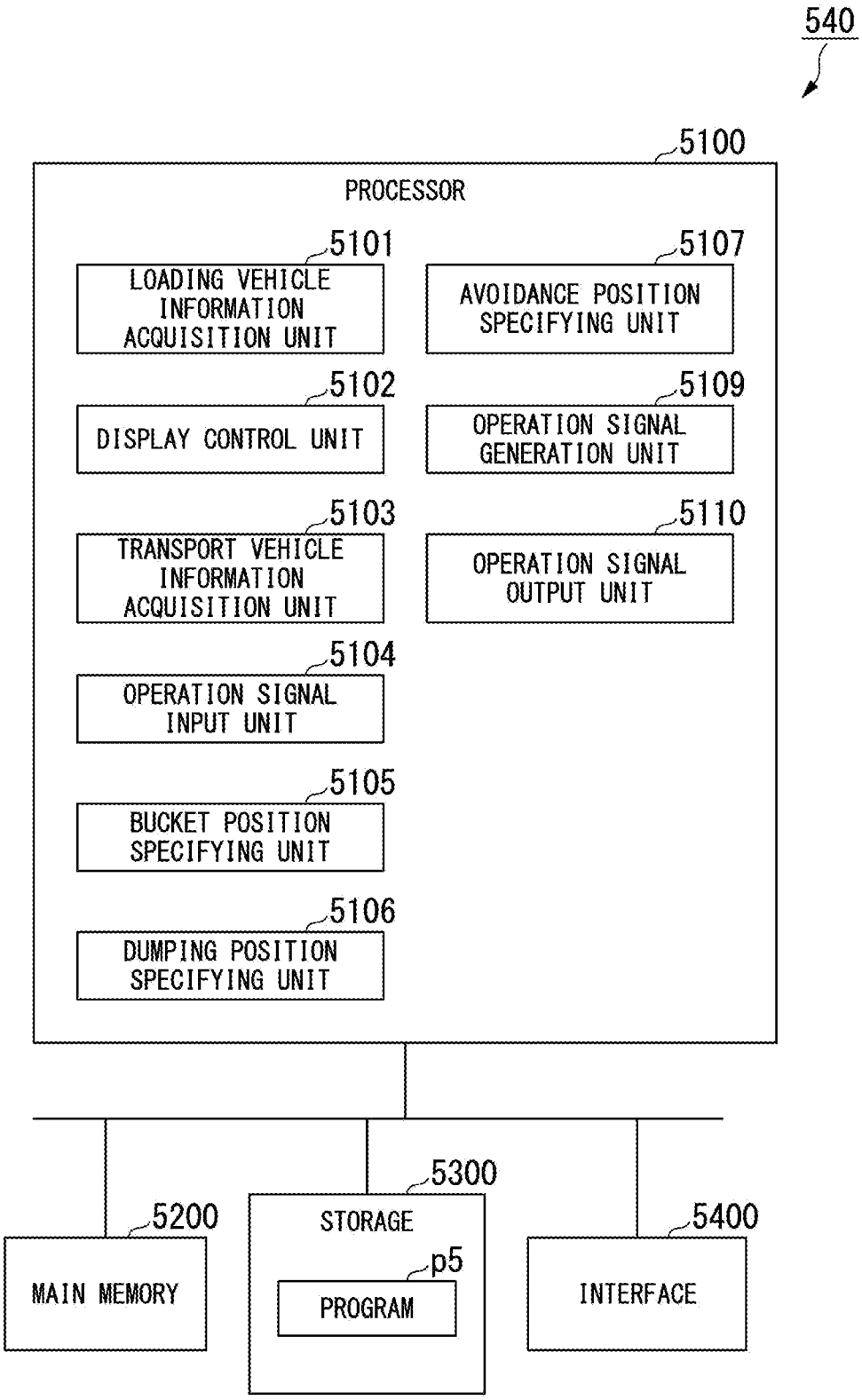
FIG. 5 is a schematic block diagram showing a configuration of a control device of a remote operation room according to the first embodiment.

FIG. 5 is a schematic block diagram showing a configuration of the control device of the remote operation room according to the first embodiment.

The control device 540 is a computer including a processor 5100, a main memory 5200, a storage 5300, and an interface 5400. The storage 5300 stores a program p5. The processor 5100 reads the program p5 from the storage 5300, loads the program p5 in the main memory 5200, and executes processing according to the program p5. The control device 540 is connected to the network via the interface 5400.

Examples of the storage 5300 include an HDD, an SSD, a magnetic disk, a magneto-optical disk, a CD-ROM, a DVD-ROM, a semiconductor memory, and the like. The storage 5300 may be an internal medium directly connected to a common communication line of the control device 540, or may be an external medium connected to the control device 540 via the interface 5400. The storage 5300 is a non-temporary tangible storage medium.

The processor 5100 includes a loading vehicle information acquisition unit 5101, a display control unit 5102, a transport vehicle information acquisition unit 5103, an operation signal input unit 5104, a bucket position specifying unit 5105, a dumping position specifying unit 5106, an avoidance position specifying unit 5107, an operation signal generation unit 5109, and an operation signal output unit 5110 by execution of the program p5.

The loading vehicle information acquisition unit 5101 acquires vehicle information from the work machine 100.

The display control unit 5102 generates a display signal for displaying an image included in vehicle information received by the loading vehicle information acquisition unit 5101, and outputs the display signal to the display device 520.

The transport vehicle information acquisition unit 5103 acquires the position information and the azimuth direction information of each transport vehicle 200 from the management apparatus 300.

The operation signal input unit 5104 receives an input of an operation signal from the first operation device 530. The operation signal includes an operation signal of the boom 111, an operation signal of the arm 112, an operation signal of the bucket 113, a swing operation signal of the swing body 120, a travel operation signal of the traveling body 130, and a dumping instruction signal of the work machine 100. The dumping instruction signal is a signal for instructing automatic dumping control of moving the bucket 113 to a dumping position and performing dumping.

Figure 6:
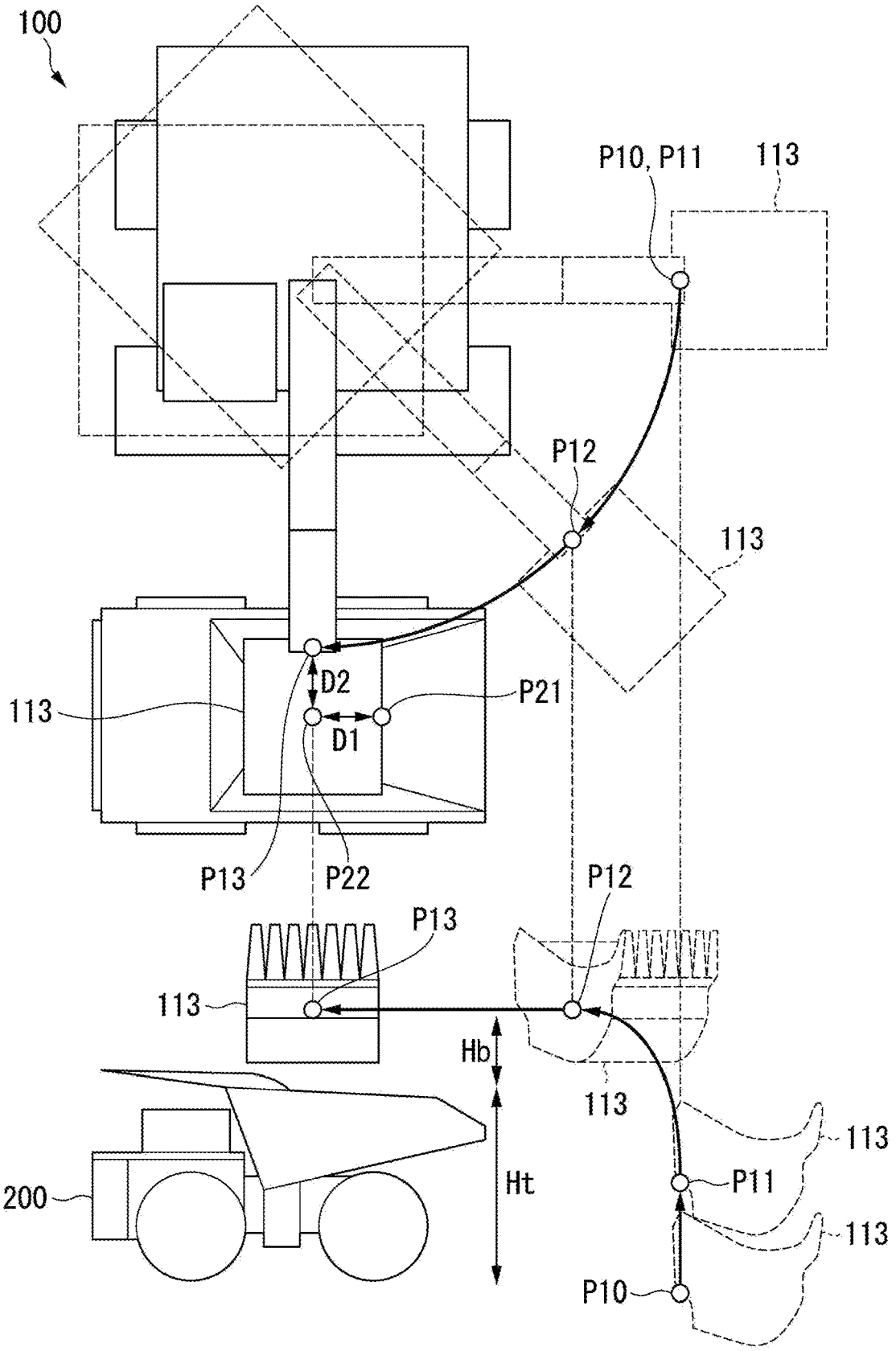
FIG. 6 is a diagram showing an example of a route of a bucket according to the first embodiment.

The bucket position specifying unit 5105 specifies a position P of the front end of the arm 112 and a height Hb from the front end of the arm 112 to a bottom point of the bucket 113 in the shovel coordinate system based on the vehicle information received by the loading vehicle information acquisition unit 5101. The bottom point of the bucket 113 is a point on an outer shape of the bucket 113 that has the shortest distance from the ground surface. In particular, the bucket position specifying unit 5105 specifies the position P of the front end of the arm 112 when receiving an input of the dumping instruction signal, as an excavation completion position P10. FIG. 6 is a diagram showing an example of a route of the bucket according to the first embodiment. Specifically, the bucket position specifying unit 5105 obtains a vertical component and a horizontal component of a length of the boom 111 based on the tilt angle of the boom 111 and a known length of the boom 111 (a distance from the pin at the base end portion to the pin at the front end portion). Similarly, the bucket position specifying unit 5105 obtains a vertical component and a horizontal component of a length of the arm 112. The bucket position specifying unit 5105 specifies a position separated from the position of the work machine 100 by a sum of the vertical components of the lengths of the boom 111 and the arm 112 and a sum of the horizontal components of the lengths of the boom 111 and the arm 112, in a direction specified from the azimuth direction and the posture of the work machine 100, as the position P of the front end of the arm 112 (the position P of the pin at the front end portion of the arm 112 shown in FIG. 2). In addition, the bucket position specifying unit 5105 specifics the bottom point of the bucket 113 in the vertical direction based on the tilt angle and the known shape of the bucket 113, and specifies the height Hb from the front end of the arm 112 to the bottom point of the bucket 113.

In a case where the dumping instruction signal is input to the operation signal input unit 5104, the dumping position specifying unit 5106 specifies a dumping position P13 based on the position information and the azimuth direction information of the transport vehicle 200 that are acquired by the transport vehicle information acquisition unit 5103. That is, the dumping position specifying unit 5106 specifies the dumping position P13 based on the position information and the azimuth direction information when the transport vehicle 200 stops at the loading point P3. The dumping position specifying unit 5106 converts a reference position P21 indicated by the position information of the transport vehicle 200 from the work site coordinate system to the shovel coordinate system based on the position, the azimuth direction, and the posture of the swing body 120 that are acquired by the loading vehicle information acquisition unit 5101, and specifies a dumping point P22 separated from the reference position P21 by a distance D1 in a direction indicated by the azimuth direction information of the transport vehicle 200. The distance D1 is a known distance between the reference position P21 and the dumping point P22 on the vessel. The dumping position specifying unit 5106 specifies a position separated from the specified position P22 by a distance D2 from the center of the bucket 113 to the front end of the arm 112 in the facing direction of the swing body 120 of the work machine 100, as a plane position of a dumping position P13. The dumping position specifying unit 5106 specifies a height of the dumping position P13 by adding the height Hb from the front end of the arm 112 to the bottom point of the bucket 113 and a height of a control margin of the bucket 113, to a height Ht of the transport vehicle 200, the height Hb being specified by the bucket position specifying unit 5105. In another embodiment, the dumping position specifying unit 5106 may specify the dumping position P13 without adding the height of the control margin. That is, the dumping position specifying unit 5106 may specify the height of the dumping position P13 by adding the height Hb to the height Ht.

The avoidance position specifying unit 5107 specifies an interference avoidance position P12 as a point that does not interfere with the transport vehicle 200, based on the dumping position P13 specified by the dumping position specifying unit 5106, the position of the work machine 100 acquired by the loading vehicle information acquisition unit 5101, and the position and the azimuth direction of the transport vehicle 200 acquired by the transport vehicle information acquisition unit 5103. The interference avoidance position P12 is a position which has the same height as the dumping position P13, at which a distance from the center of swing of the swing body 120 is equal to a distance from the center of swing of the swing body 120 to the dumping position P13, and below which the transport vehicle 200 is not present.

For example, the avoidance position specifying unit 5107 sets the center of swing of the swing body 120 as the center, specifies a circle of which the radius is a distance between the center of swing and the dumping position, and specifies a position on the circle at which the outer shape of the bucket 113 does not interfere with the transport vehicle 200 in a plan view and which is the closest position to the dumping position P13, as the interference avoidance position P12. The avoidance position specifying unit 5107 can determine whether or not the transport vehicle 200 and the bucket 113 interfere with each other based on the position, the azimuth direction, and the known outer shape of the transport vehicle 200, and the known shape of the bucket 113. Here, "same height" and "equal distance" are not necessarily limited to heights or distances that completely match each other, and some error or margin is allowed.

The operation signal generation unit 5109 generates an operation signal for moving the bucket 113 to the dumping position P13 based on the dumping position P13 specified by the dumping position specifying unit 5106 and the interference avoidance position P12 specified by the avoidance position specifying unit 5107. That is, the operation signal generation unit 5109 generates an operation signal for moving the bucket 113 from the excavation completion position P10 to the dumping position P13 via a position P11 and the interference avoidance position P12. Further, the operation signal generation unit 5109 generates an operation signal of the bucket 113 such that the angle of the bucket 113 does not change even when the boom 111 and the arm 112 are driven.

The operation signal output unit 5110 outputs the operation signal which is input to the operation signal input unit 5104 or the operation signal generated by the operation signal generation unit 5109, to the work machine 100.

«Method»

The transport vehicle 200 travels along the traveling route R according to the course information generated by the management apparatus 300, and stops at the standby point P1. The operator of the work machine 100 inputs an entry instruction signal to the second operation device 531 by operating the second operation device 531 (for example, pressing a predetermined button). The entry instruction signal is transmitted from the second operation device 531 to the management apparatus 300. Thereby, the management apparatus 300 generates course information indicating areas of the entry route R2 and the approach route R3. The transport vehicle 200 travels along the approach route R3 and stops at the loading point P3. Excavation of earth and sand is performed using the bucket 113 of the work machine 100 by an operation of the first operation device 530 by the operator, and a dumping instruction signal is generated and output by an operation of the knob switch of the first operation device 530 by the operator.

Figure 7:
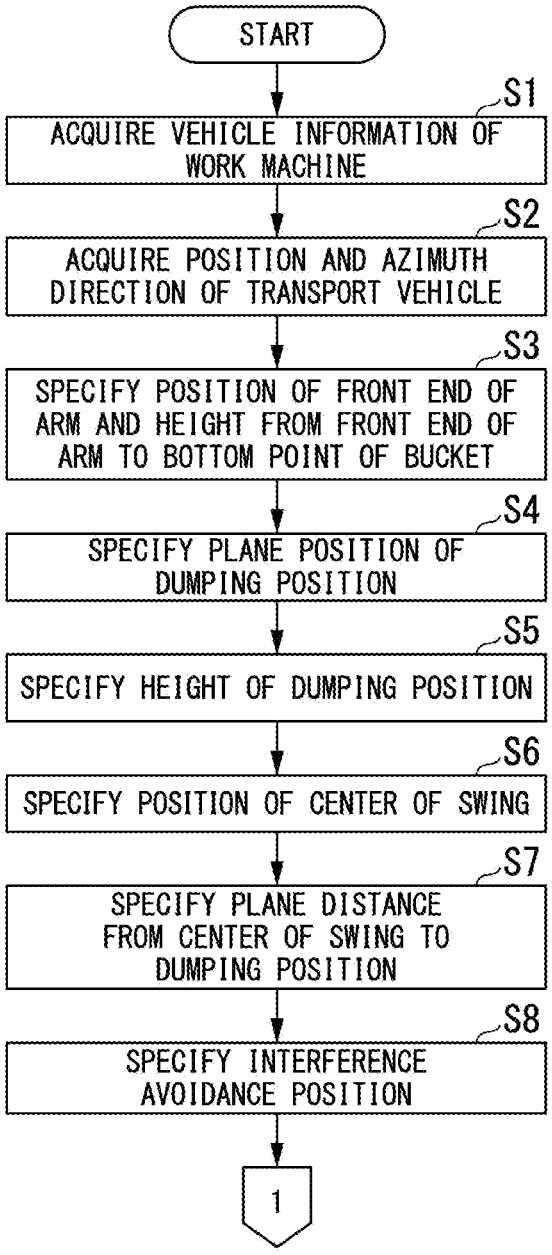
FIG. 7 is a first flowchart showing an automatic dumping control method of the remote operation room according to the first embodiment.
Figure 8:
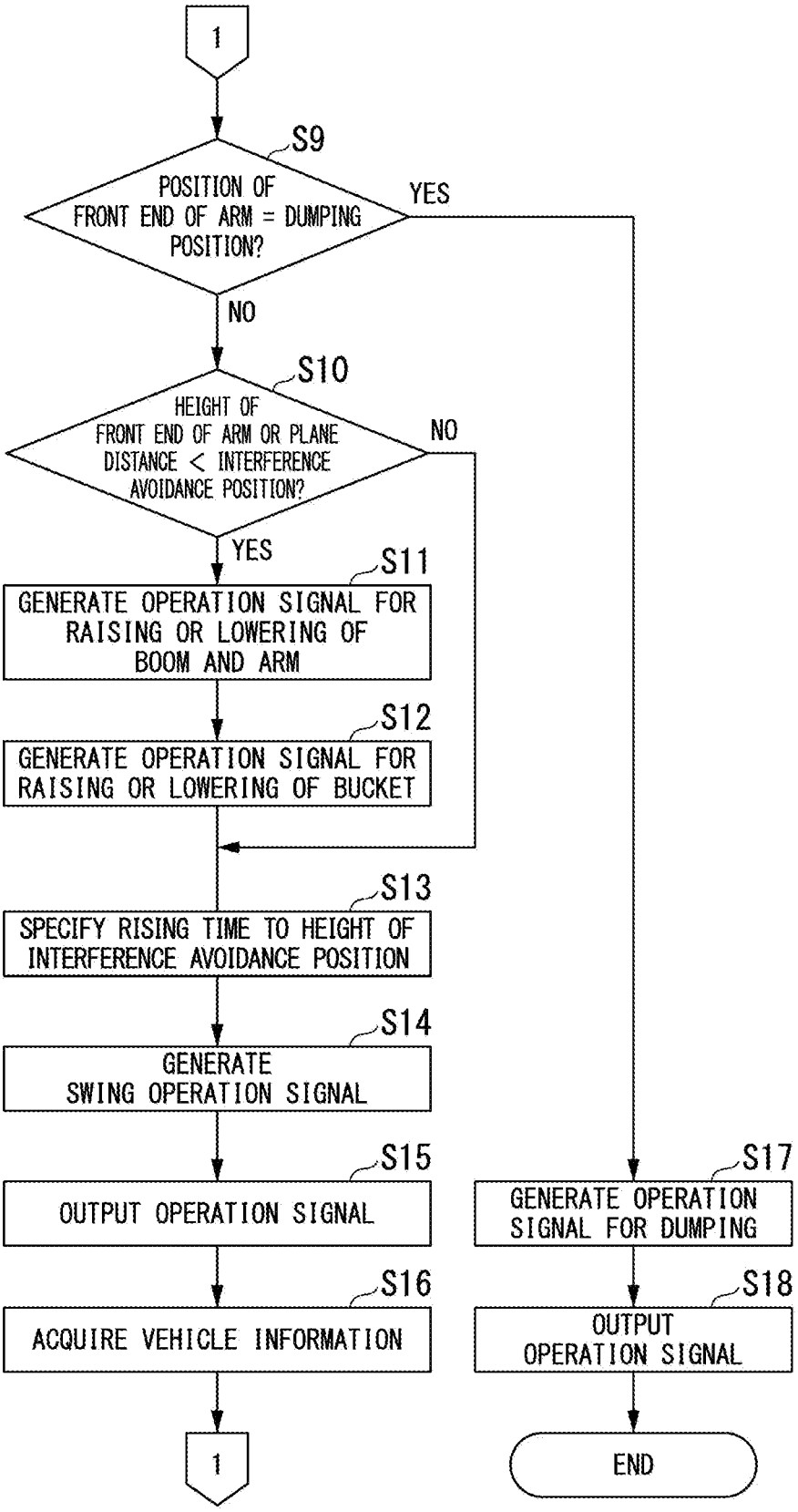
FIG. 8 is a second flowchart showing an automatic dumping control method of the remote operation room according to the first embodiment.

FIG. 7 is a first flowchart showing an automatic dumping control method of the remote operation room according to the first embodiment. FIG. 8 is a second flowchart showing an automatic dumping control method of the remote operation room according to the first embodiment. When an input of a dumping instruction signal is received from the operator, the control device 540 executes automatic dumping control shown in FIG. 7.

The loading vehicle information acquisition unit 5101 acquires the position and the azimuth direction of the swing body 120, the tilt angles of the boom 111, the arm 112, and the bucket 113, and the posture of the swing body 120, from the work machine 100 (step S1). The transport vehicle information acquisition unit 5103 acquires the position and the azimuth direction of the transport vehicle 200, from the management apparatus 300 (step S2).

The bucket position specifying unit 5105 specifies a position P of the front end of the arm 112 when a dumping instruction signal is input and a height from the front end of the arm 112 to the bottom point of the bucket 113 based on the vehicle information acquired by the loading vehicle information acquisition unit 5101 (step S3). The bucket position specifying unit 5105 specifics the position P as an excavation completion position P10.

The dumping position specifying unit 5106 converts the position information of the transport vehicle 200 acquired by the transport vehicle information acquisition unit 5103 from the work site coordinate system to the shovel coordinate system based on the position, the azimuth direction, and the posture of the swing body 120 acquired in step S1. The dumping position specifying unit 5106 specifies a plane position of the dumping position P13 based on the position information and the azimuth direction information of the transport vehicle 200 and the known shape of the transport vehicle 200 (step S4). At this time, the dumping position specifying unit 5106 specifies a height of the dumping position P13 by adding the height Hb from the front end of the arm 112 to the bottom point of the bucket 113 and a height of a control margin of the bucket 113, to the known height Ht of the transport vehicle 200, the height Hb being specified in step S3 (step S5).

The avoidance position specifying unit 5107 specifies a position of the center of swing of the swing body 120 based on the position and the azimuth direction of the swing body 120 acquired by the loading vehicle information acquisition unit 5101 (step S6). The avoidance position specifying unit 5107 specifies a plane distance from the center of swing to the dumping position P13 (step S7). The avoidance position specifying unit 5107 specifies a position which is separated from the center of swing by the specified plane distance, at which the outer shape of the bucket 113 does not interfere with the transport vehicle 200 in a plan view and which is the closest position to the dumping position P13, as an interference avoidance position P12 (step S8).

The operation signal generation unit 5109 determines whether or not the position of the front end of the arm 112 reaches the dumping position P13 (step S9). In a case where the position of the front end of the arm 112 does not reach the dumping position P13 (NO in step S9), the operation signal generation unit 5109 determines whether or not the height of the front end of the arm 112 is lower than the height of the interference avoidance position P12 or whether or not a plane distance from the center of swing of the swing body 120 to the front end of the arm 112 is shorter than a plane distance from the center of swing of the swing body 120 to the interference avoidance position P12 (step S10). In a case where the height of the bucket 113 is lower than the height of the interference avoidance position P12, or in a case where the plane distance from the center of swing of the swing body 120 to the front end of the arm 112 is shorter than the plane distance from the center of swing of the swing body 120 to the interference avoidance position P12 (YES in step S10), the operation signal generation unit 5109 generates an operation signal for raising the boom 111 and the arm 112 to the height of the interference avoidance position P12 (step S11). At this time, the operation signal generation unit 5109 generates an operation signal based on the positions and the speeds of the boom 111 and the arm 112.

Further, the operation signal generation unit 5109 calculates a sum of angular velocities of the boom 111 and the arm 112 based on the generated operation signals of the boom 111 and the arm 112, and generates an operation signal for rotating the bucket 113 at the same speed as the sum of the angular velocities (step S12). Thereby, the operation signal generation unit 5109 can generate an operation signal for holding an angle of the bucket 113 with respect to the ground. In another embodiment, the operation signal generation unit 5109 may generate an operation signal for rotating the bucket 113 such that the angle of the bucket 113 with respect to the ground, which is calculated from detection values of the boom angle sensor 117, the arm angle sensor 118, and the bucket angle sensor 119, is equal to the angle of the bucket 113 with respect to the ground when automatic dumping control is started.

In a case where the height of the bucket 113 is equal to or higher than the height of the interference avoidance position P12 (NO in step S10), the operation signal generation unit 5109 does not generate operation signals of the boom 111, the arm 112, and the bucket 113.

Next, the operation signal generation unit 5109 specifies a raising time which is a time for which the height of the bucket 113 moves from the height of the excavation completion position P10 to the height of the interference avoidance position P12 (step S13). The operation signal generation unit 5109 generates a swing operation signal (step S14). At this time, after the height of the bucket 113 becomes equal to or higher than the height of the interference avoidance position P12, the operation signal generation unit 5109 generates a swing operation signal for swing the swing body 120 based on the raising time of the bucket 113 such that the front end of the arm 112 passes through the interference avoidance position P12.

When at least one of the operation signals of the boom 111, the arm 112, and the bucket 113, and the swing operation signal of the swing body 120 is generated in processing of step S9 to step S14, the operation signal output unit 5110 outputs the generated operation signal to the work machine 100 (step S15). The loading vehicle information acquisition unit 5101 acquires vehicle information from the work machine 100 (step S16). Thereby, the loading vehicle information acquisition unit 5101 can acquire the vehicle information after the work machine 100 is driven by the output operation signal. The control device 540 returns to the processing of step S9, and repeatedly executes generation of operation signals.

On the other hand, in a case where the position of the front end of the arm 112 reaches the dumping position P13 in step S9 (YES in step S9), the operation signal generation unit 5109 does not generate an operation signal. Thereby, when the position of the front end of the arm 112 reaches the dumping position P13, the work equipment 110 and the swing body 120 are stopped. In the case where the position of the front end of the arm 112 reaches the dumping position P13 (YES in step S9), that is, in the case where the operation signal generation unit 5109 does not generate an operation signal in processing of step S9 to step S14, the operation signal generation unit 5109 generates an operation signal for dumping earth of the bucket 113 (step S17). Examples of the operation signal for dumping earth of the bucket 113 include an operation signal for rotating the bucket 113 in a dumping direction and an operation signal for opening a clamshell when the bucket 113 is a clamshell bucket. The operation signal output unit 5110 outputs the generated operation signal to the work machine 100 (step S18). The control device 540 ends automatic dumping control.

Here, an operation of the work machine 100 when automatic dumping control is performed will be described with reference to FIG. 6.

When automatic dumping control is started, the boom 111 and the arm 112 are raised from the excavation completion position P10 toward the position P11. At this time, the bucket 113 is driven while maintaining the angle when excavation is completed.

When the front end of the arm 112 reaches the position P11, the swing body 120 starts swinging toward the dumping position P13. At this time, since the front end of the arm 112 does not reach the height of the interference avoidance position P12, the boom 111 and the arm 112 continue to be raised. While the front end of the arm 112 moves from the position P11 to the interference avoidance position P12, the boom 111, the arm 112, and the bucket 113 decelerate such that the height of the front end of the arm 112 becomes equal to the height of the interference avoidance position P12.

When the front end of the arm 112 reaches the interference avoidance position P12, driving of the work equipment 110 is stopped. On the other hand, the swing body 120 continues swinging. That is, in a section from the interference avoidance position P12 to the dumping position P13, the front end of the arm 112 is moved only by swinging of the swing body 120 without driving of the work equipment 110. While the front end of the arm 112 moves from the position P11 to the dumping position P13, the swing body 120 decelerates such that the position of the front end of the arm 112 becomes equal to the dumping position P13.

When the front end of the arm 112 reaches the dumping position P13, driving of the work equipment 110 and the swing body 120 is stopped. Thereafter, the bucket 113 performs a dumping operation.

By the automatic dumping control, the work machine 100 can automatically dump earth and sand excavated by the bucket 113 to the transport vehicle 200. The excavation by the work equipment 110 and the automatic dumping control based on the input of the dumping instruction signal arc repeatedly performed by the operator to such an extent that a load of the transport vehicle 200 does not exceed the maximum load. The operator inputs a start instruction signal to the second operation device 531 by operating the second operation device 531. The start instruction signal is transmitted from the second operation device 531 to the management apparatus 300. Thereby, the management apparatus 300 generates course information including an area of the exit route R4. The transport vehicle 200 starts from the loading point P3, travels along the exit route R4, and exits from the loading place A1.

«Operation and Effect»

According to the first embodiment, the control device 540 specifies the dumping position for loading the earth and sand onto the transport vehicle 200 based on the position information and the azimuth direction information of the transport vehicle 200 that are detected by the transport vehicle 200. Thereby, the control device 540 can automatically operate the work machine 100 without receiving designation of the dumping position by the operator or the like.

Further, according to the first embodiment, the control device 540 specifies the excavation completion position P10 of the bucket 113, and generates an operation signal for moving the bucket 113 from the excavation completion position P10 to the dumping position P13. Thereby, the control device 540 can automatically dump earth and sand excavated by the bucket 113 to the transport vehicle 200.

Further, according to the first embodiment, the control device 540 generates a control signal for causing the bucket 113 to pass through the interference avoidance position P12. The interference avoidance position P12 according to the first embodiment is a position which has the same height as the dumping position P13, at which a distance from the center of swing of the swing body 120 is equal to a distance from the center of swing of the swing body 120 to the dumping position P13, and below which the transport vehicle 200 is not present in consideration of the outer shape of the bucket 113. Accordingly, it is possible to reliably prevent the bucket 113 from coming into contact with the transport vehicle 200 due to swinging of the swing body 120.

Second Embodiment

In the work system 1 according to the first embodiment, the work machine 100 performs single-sided loading. That is, according to the first embodiment, since the plurality of transport vehicles 200 travel based on one traveling route R, the transport vehicles 200 sequentially stop at one loading point P3. Thereby, the work machine 100 sequentially performs loading onto the transport vehicles 200 located at the loading point P3.

Figure 9:
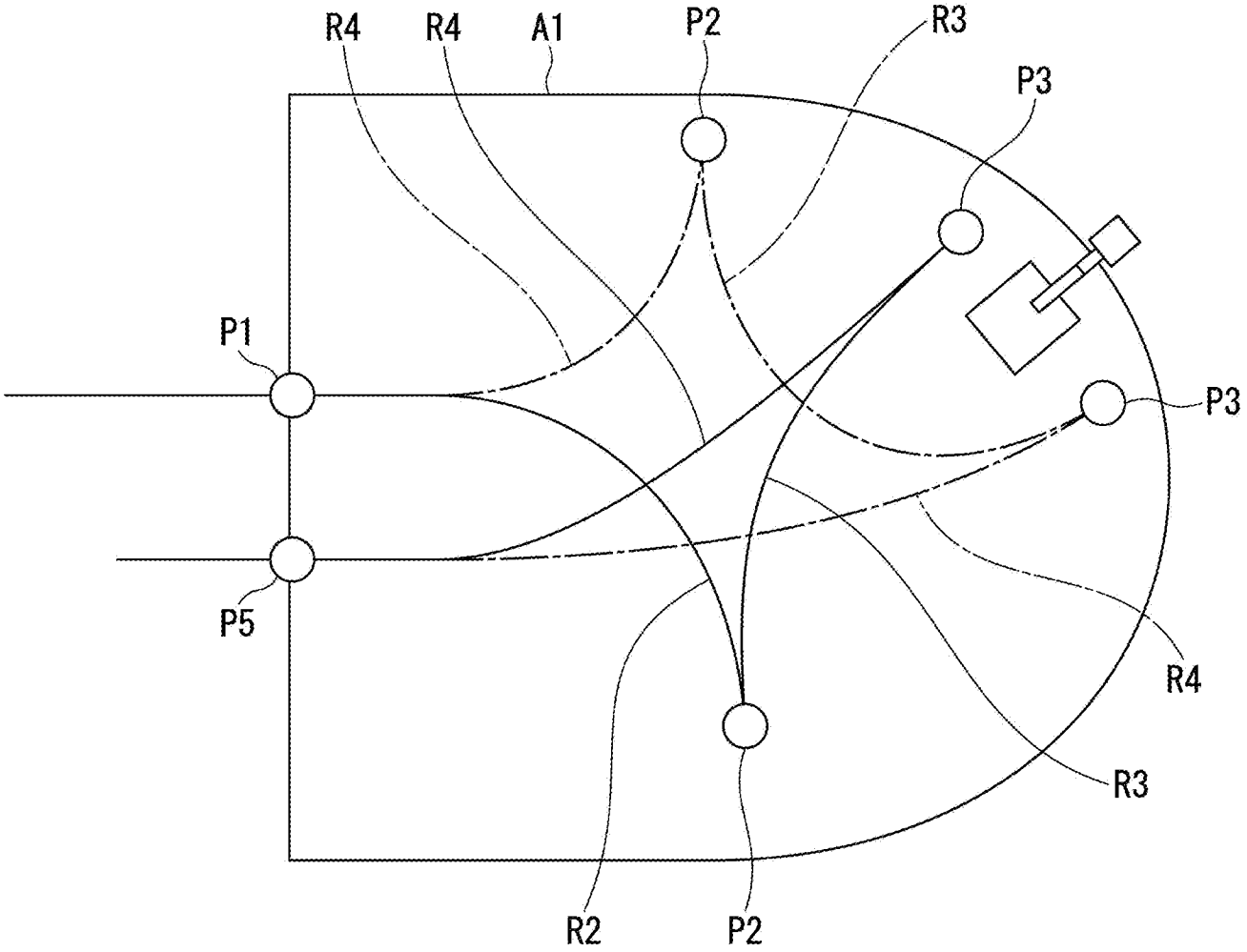
FIG. 9 is a diagram showing an example of a traveling route in a loading place according to a second embodiment.

On the other hand, in the work system 1 according to a second embodiment, the work machine 100 performs double-sided loading. FIG. 9 is a diagram showing an example of a traveling route in a loading place according to a second embodiment. In the second embodiment, two traveling routes R are provided, and thus loading points P3 are generated on left and right sides of the work machine 100. Thereby, while the work machine 100 performs loading onto the transport vehicle 200 stopping at one loading point P3, another transport vehicle 200 can stand by at the other loading point P3. By performing double-sided loading in this manner, the work machine 100 can start a next loading operation immediately after completing a certain loading operation. Although two loading points P3 are included in the loading place A1 according to the second embodiment, the present invention is not limited thereto, and three or more loading points P3 may be included in the loading place A1.

«Control Device of Remote Operation Room»

Figure 10:
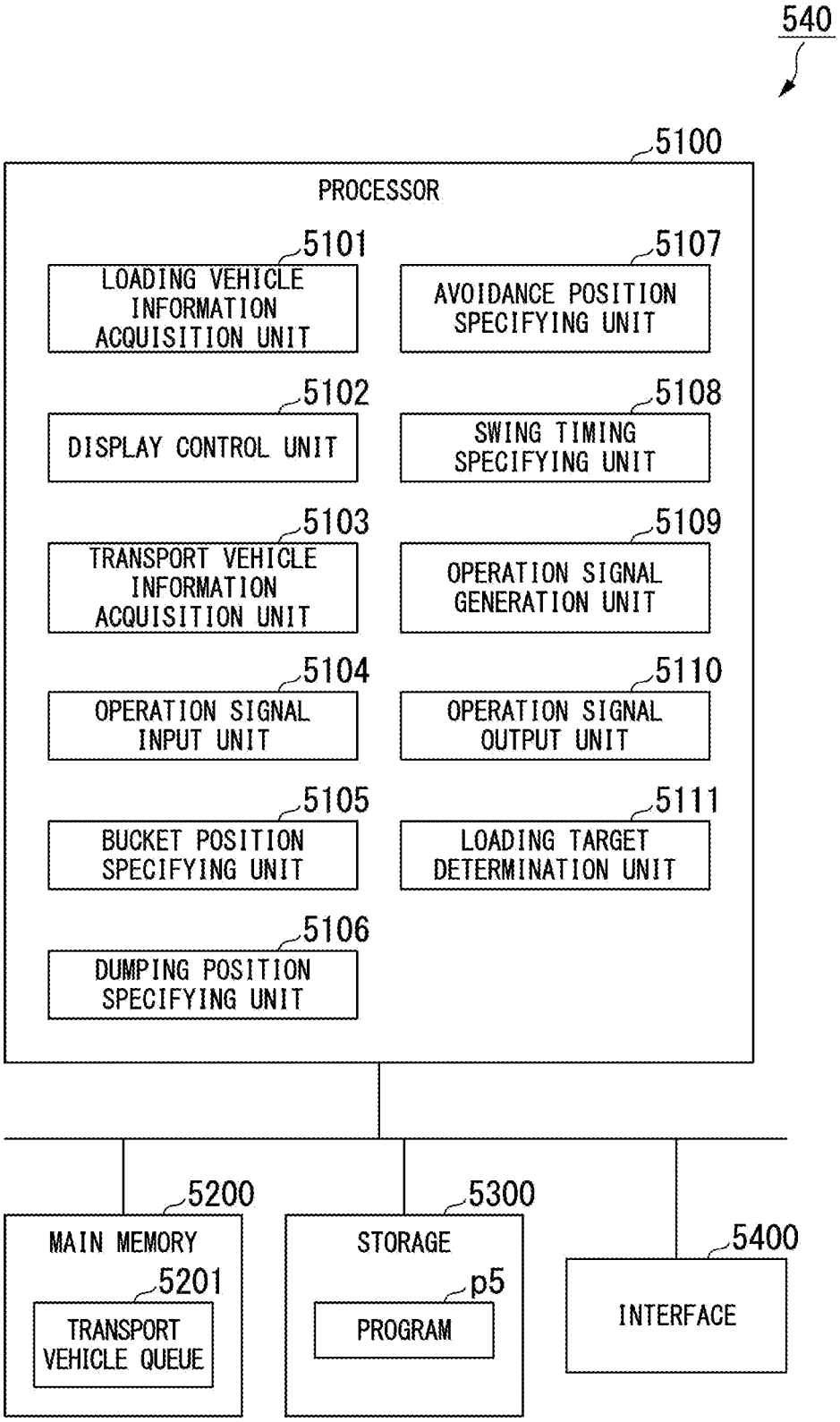
FIG. 10 is a schematic block diagram showing a configuration of the control device of the remote operation room according to the second embodiment.

FIG. 10 is a schematic block diagram showing a configuration of the control device of the remote operation room according to the second embodiment.

The control device 540 according to the second embodiment further includes a loading target determination unit 5111 in addition to the configuration of the first embodiment. Further, in the main memory 5200 of the control device 540 according to the second embodiment, a storage area of a transport vehicle queue 5201 is allocated.

The transport vehicle queue 5201 stores identification information of the transport vehicle 200 as a loading target in loading order. The identification information of the transport vehicle 200 is extracted (dequeued) from the top of the transport vehicle queue 5201, and is added (enqueued) to the end of the transport vehicle queue 5201.

The loading target determination unit 5111 extracts the identification information of the transport vehicle 200 from the top of the transport vehicle queue 5201, and determines the transport vehicle 200 indicated by the identification information as a loading target. When the transport vehicle 200 stops at the loading point P3, the loading target determination unit 5111 adds the identification information of the transport vehicle 200 to the end of the transport vehicle queue 5201.

Here, an operation of the control device 540 according to the second embodiment will be described.

Figure 11:
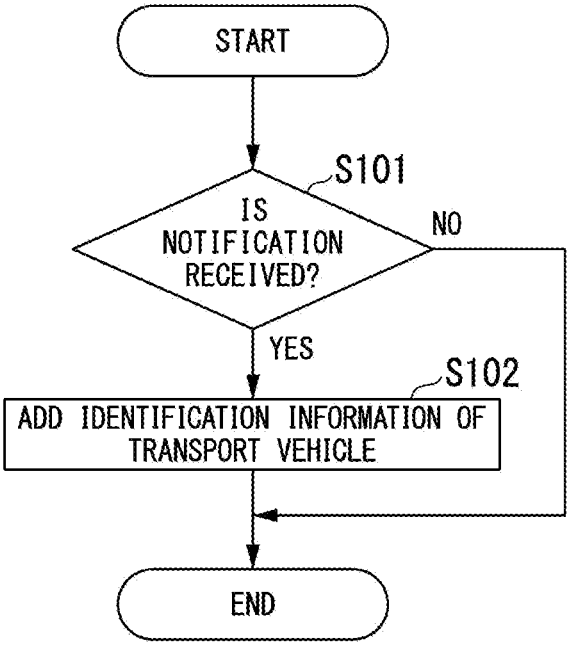
FIG. 11 is a flowchart showing a method of registering an unmanned transport vehicle according to the second embodiment.

FIG. 11 is a flowchart showing a method of registering an unmanned transport vehicle according to the second embodiment.

The management apparatus 300 determines whether or not the transport vehicle 200 stops at the loading point P3 based on the position of the transport vehicle 200 at regular time intervals. When it is determined that the transport vehicle 200 stops at the loading point P3, the management apparatus 300 notifies the remote operation room 500 that the transport vehicle 200 stops at the loading point P3. The identification information of the transport vehicle 200 is included in the notification.

The control device 540 of the remote operation room 500 executes processing shown in FIG. 11 at regular time intervals. The transport vehicle information acquisition unit 5103 of the control device 540 determines whether or not a notification indicating that the transport vehicle 200 stops at the loading point P3 is received from the management apparatus 300 (step S101). In a case where a notification indicating that the transport vehicle 200 stops at the loading point P3 is received (YES in step S101), the loading target determination unit 5111 adds the identification information of the transport vehicle 200 included in the notification to the end of the transport vehicle queue 5201 (step S102). On the other hand, in a case where a notification indicating that the transport vehicle 200 reaches the loading point P3 is not received (NO in step S101), the loading target determination unit 5111 does not add the identification information to the transport vehicle queue 5201.

The loading target determination unit 5111 of the control device 540 reads identification information from the top of the transport vehicle queue 5201, and the dumping position specifying unit 5106 specifies a dumping position for the transport vehicle 200 indicated by the identification information in step S4 of the flowchart shown in FIG. 7. In a case where a start instruction signal is input to the operation signal input unit 5104, the loading target determination unit 5111 extracts identification information from the top of the transport vehicle queue 5201.

«Operation and Effect»

In a case where the transport vehicles 200 are at each of a plurality of loading points P3, the control device 540 according to the second embodiment generates an operation signal based on the dumping position P13 for the transport vehicle 200 that first arrives at the loading point P3 among the plurality of transport vehicles 200. After a start instruction signal is transmitted to the transport vehicle 200 on which loading is completed, the identification information on the top of the transport vehicle queue 5201 is read, and loading onto the next transport vehicle 200 is performed. This operation is repeated. Thereby, the control device 540 can cause the work machine 100 to perform loading processing in order of arrival of the transport vehicles 200.

Accordingly, the control device 540 according to the second embodiment can shorten a time during which the transport vehicle 200 stops for loading, as compared with, for example, a case where a loading target is determined so as to minimize a swing angle of the work machine 100.

Other Embodiments

Although embodiments have been described in detail as above with reference to the drawings, a specific configuration is not limited to the embodiments, and various design changes may be made.

For example, although the control device 540 according to the second embodiment determines a loading target based on the information stored in the transport vehicle queue 5201, the present invention is not limited thereto. For example, the control device 540 according to another embodiment may determine a loading target based on a database that stores the identification information of each of the plurality of transport vehicles 200 and a flag indicating a loading target in association with each other. In this case, as in the second embodiment, the control device 540 rewrites the flag in a case where a start instruction signal is input to the operation signal input unit 5104.

The control device 540 according to the second embodiment determines the transport vehicle 200 that first arrives at the loading point P3 as a loading target in a case where the transport vehicles 200 are present at each of the plurality of loading points P3; however, the present invention is not limited thereto. For example, the control device 540 according to another embodiment may determine a loading target by an arbitrary method such as a method of determining, as a loading target, the transport vehicle currently having the largest load among the transport vehicles 200 that are present at each of the plurality of loading points P3.

In the work system 1 according to the embodiment, the control device 540 of the remote operation room 500 performs calculation for automatic dumping processing and determination of the loading target based on the position information and the azimuth direction information of the transport vehicle 200 received from the management apparatus 300; however, the present invention is not limited thereto. For example, in the work system 1 according to another embodiment, the control device 126 of the work machine 100 may perform calculation for automatic dumping processing and determination of the loading target based on the position information and the azimuth direction information of the transport vehicle 200 received from the management apparatus 300.

In the work system 1 according to the embodiment, the control device 540 of the remote operation room 500 performs calculation for automatic dumping processing based on the position information and the azimuth direction information of the transport vehicle 200 received from the management apparatus 300; however, the present invention is not limited thereto. For example, in the work system 1 according to another embodiment, the control device 126 of the work machine 100 may perform calculation for automatic dumping processing based on the position information and the azimuth direction information of the transport vehicle 200 received from the management apparatus 300.

Although the work machine 100 according to the embodiment is operated by a remote operation, the present invention is not limited thereto. For example, the work machine 100 according to another embodiment may be operated by a lever operation or a switch operation by an operator who gets in the operation room 121. In this case, the control device 126 of the work machine 100 may perform calculation for automatic dumping processing and determination of the loading target based on the position information and the azimuth direction information of the transport vehicle 200 received from the management apparatus 300.

Further, in the embodiment, although the work machine 100 acquires the position and the azimuth direction of the transport vehicle 200 from the management apparatus 300, the present invention is not limited thereto. For example, the work machine 100 according to another embodiment may acquire the position and the azimuth direction of the transport vehicle 200 from the transport vehicle 200 by inter-vehicle communication.

In the work system 1 according to the embodiment, the dumping position P13 is specified based on the position information and the azimuth direction information when the transport vehicle 200 stops at the loading point P3; however, another embodiment of the present invention is not limited thereto. For example, in another embodiment, the dumping position P13 may be specified based on the position of the loading point P3 instead of the position information and the azimuth direction information of the transport vehicle 200. In this case, the work system 1 can specify the loading point P3 before the transport vehicle 200 stops.

In the work system 1 according to the embodiment, the work machine 100 loads earth and sand as a load; however, another embodiment of the present invention is not limited thereto. For example, a load according to another embodiment may be ore, crushed stone, coal, or the like.

In the control device 540 according to the embodiment, although the case where the program p5 is stored in the storage 5300 has been described, the present invention is not limited thereto. For example, in another embodiment, the program p5 may be distributed to the control device 540 by a communication line. In this case, when the distributed program p5 is received, the control device 540 loads the program p5 in the main memory 5200, and executes the processing according to the program p5.

In the embodiment, although the automatic dumping control such as specifying of the dumping position is performed in the shovel coordinate system, the automatic dumping control may be performed in the work site coordinate system.

Further, the program p5 may be a program for realizing some of the above-described functions. For example, the program p5 may be a program for realizing the above-described functions in combination with another program p5 already stored in the storage 5300 or another program p5 embedded in another device.

Further, the control device 126, the management apparatus 300, and the control device 540 may include a programmable logic device (PLD) in addition to or instead of the configuration. Examples of a PLD include a programmable array logic (PAL), a generic array logic (GAL), a complex programmable logic device (CPLD), and a field programmable gate array (FPGA). In this case, some of the functions realized by the processor may be realized by the PLD.

INDUSTRIAL APPLICABILITY

The work machine control device according to the present invention can automatically specify the dumping position for control of the work machine.

REFERENCE SIGNS LIST

1: Work System
100: Work Machine
200: Transport Vehicle
300: Management Apparatus
3101: Position and Azimuth Direction Collection Unit
3102: Traveling Course Generation Unit
3103: Transmission Unit
3301: Traveling Route Storage Unit
3302: Position and Azimuth Direction Storage Unit
500: Remote Operation Room
510: Driver's Seat
520: Display Device
530: Operation Device
540: Control Device
5101: Loading Vehicle Information Acquisition Unit
5102: Display Control Unit
5103: Transport Vehicle Information Acquisition Unit
5104: Operation Signal Input Unit
5105: Bucket Position Specifying Unit
5106: Dumping Position Specifying Unit
5107: Avoidance Position Specifying Unit
5108: Swing Timing Specifying Unit
5109: Operation Signal Generation Unit
5110: Operation Signal Output Unit
5111: Loading Target Determination Unit

The invention claimed is:

1. A work machine control device for controlling a work machine that includes a swing body and work equipment attached to the swing body and including a bucket, the work machine control device comprising:

a transport vehicle information acquisition unit that acquires position information and azimuth direction information of an unmanned transport vehicle, the position information and the azimuth direction information being detected by a position and azimuth direction detector on the unmanned transport vehicle; and a dumping position specifying unit that specifies a dumping position for loading a load onto the unmanned transport vehicle based on the position information and the azimuth direction information.

2. The work machine control device according to claim 1, further comprising:

a bucket position specifying unit that specifies a position of the bucket when a dumping instruction signal for moving the bucket to the dumping position is input; and an operation signal generation unit that generates an operation signal for moving the bucket from the specified position to the dumping position.

3. The work machine control device according to claim 2, further comprising:

an avoidance position specifying unit that specifies an interference avoidance position as a position which has the same height as the dumping position, at which a distance from a center of swing of the swing body is equal to a distance from the center of swing of the swing body to the dumping position, and below which the unmanned transport vehicle is not present, wherein the operation signal generation unit generates the operation signal such that the bucket passes through the interference avoidance position.

4. The work machine control device according to claim 2, further comprising:

a loading target determination unit that determines one unmanned transport vehicle among at least two unmanned transport vehicles as a loading target, in a case where the at least two unmanned transport vehicles are present at each of at least two loading points among loading points which are set at a plurality of locations, wherein the operation signal generation unit generates the operation signal based on the dumping position for the unmanned transport vehicle until the unmanned transport vehicle that is a loading target starts to move.

5. A control method of a work machine that includes a swing body which swings around a center of swing of the swing body and work equipment attached to the swing body and including a bucket, the control method comprising the steps of:

acquiring position information and azimuth direction information of an unmanned transport vehicle, the position information and the azimuth direction information being detected by a position and azimuth direction detector on the unmanned transport vehicle; and outputting an operation signal for moving the bucket to a dumping position for loading a load onto the unmanned transport vehicle based on the position information and the azimuth direction information.

6. The work machine control device according to claim 3, further comprising:

a loading target determination unit that determines one unmanned transport vehicle among at least two unmanned transport vehicles as a loading target, in a case where the at least two unmanned transport vehicles are present at each of at least two loading points among loading points which are set at a plurality of locations, wherein the operation signal generation unit generates the operation signal based on the dumping position for the unmanned transport vehicle until the unmanned transport vehicle that is a loading target starts to move.

* * * * *